US005945218A

United States Patent [19]

Nakao et al.

[11] Patent Number: 5,945,218

[45] Date of Patent: Aug. 31, 1999

[54] PROCESS FOR FORMATION OF MULTILAYER FILM

[75] Inventors: Yasushi Nakao, Oobu; Shigeru Nakamura, Owariasahi, both of Japan

[73] Assignee: Kansai Paint Co., Ltd., Japan

[21] Appl. No.: 09/066,273

[22] Filed: Apr. 24, 1998

[30] Foreign Application Priority Data

Apr. 25, 1997 [JP] Japan ..... 9-108464

[51] Int. Cl.[6] ..... B05D 1/36; B05D 3/02; B05D 7/26

[52] U.S. Cl. ..... 428/403; 427/407.1; 427/409; 427/419.2; 428/407; 428/411.1

[58] Field of Search ..... 427/407.1, 409, 427/419.2, 410; 106/403; 428/403, 407, 411.1

[56] References Cited

U.S. PATENT DOCUMENTS

| | | | |
|---|---|---|---|
| 4,668,570 | 5/1987 | Esselborn et al. | 427/409 |
| 4,814,208 | 3/1989 | Miyazaki et al. | 427/409 |
| 5,213,618 | 5/1993 | Souma et al. | 106/403 |
| 5,693,134 | 12/1997 | Stephens | 427/419.2 |
| 5,718,950 | 2/1998 | Komatsu et al. | 427/405 |
| 5,855,660 | 1/1999 | Bujard et al. | 106/418 |
| 5,863,321 | 1/1999 | Crumley et al. | 428/403 |
| 5,871,827 | 2/1999 | Jaffe et al. | 427/407.1 |

*Primary Examiner*—Diana Dudash
*Attorney, Agent, or Firm*—Huntley & Associates

[57] ABSTRACT

A process for forming a multilayer film having superior high white iridescent appearance which comprises applying (A) a liquid white coating which comprises a thermosetting resin composition, a metal powder coated with a white pigment, and a titanium dioxide pigment, (B) a light-iridescent coating, and (C) a clear coating onto a substrate in this order to form a multilayer film, and then heating the substantially uncured films to crosslink and cure them simultaneously.

17 Claims, No Drawings

PROCESS FOR FORMATION OF MULTILAYER FILM

BACKGROUND OF THE INVENTION

1. Field of the Invention

The present invention relates to a process for forming a multilayer film comprising a white coating film, a light-iridescent coating film and a clear coating film. More particularly, the present invention relates to a process for forming a multilayer film of reduced thickness having improved properties such as surface gloss, surface smoothness, chipping resistance and the like.

2. Description of the Prior Art

It is already known to apply a white coloring coating containing a titanium dioxide pigment and an aluminum flake having a value of N 7 to N 9 in Munsell's color system, a light-iridescent coating, and a clear coating, and heat-curing the above-applied three coatings simultaneously (see, for example, U.S. Pat. No. 5,718,950). In the thus-formed multilayer film, a light passes through the clear coating film and the light-iridescent coating film, and the hue of the white coloring coating film provides a white-pearl-like or silver-pearl-like color decorativeness together with the metallic effect of the light-iridescent coating film. Furthermore, the resulting multilayer film has an improved hiding power and can have a smaller thickness; the intermixing between the white coloring coating film and the light-iridescent coating film can be prevented; and the resulting multilayer film can have improved properties (e.g. improved chipping resistance and surface smoothness).

The multilayer film formed by the above approach, however, is insufficient in white-iridescent appearance.

SUMMARY OF THE INVENTION

The present invention eliminates the above-mentioned drawbacks in the iridescent multilayer film of the prior art and provides a novel process for forming a multilayer film superior in high white-iridescent appearance.

These drawbacks can be eliminated by using a combination of a thermosetting resin composition, a metal powder coated with a white pigment and a titanium dioxide pigment in the white coloring coating. The resulting multilayer film has an improved hiding power and is superior in high white-iridescent appearance, even when applied to obtain a film of reduced thickness, and the intermixing between the white coloring coating film and the light-iridescent coating film can be prevented. In addition, the resulting multilayer film has improved properties including improved chipping resistance and surface smoothness.

Specifically, the present invention provides process for forming a multilayer film which comprises applying, in the following order, (A) a liquid white coating comprising a thermosetting resin composition, a metal powder coated with a white pigment, and a titanium dioxide pigment, (B) a light-iridescent coating, and (C) a clear coating to form three coating films on a substrate, and heating the substantially uncured three films to crosslink and cure them simultaneously.

DETAILED DESCRIPTION OF THE INVENTION

The present invention will be more fully understood by reference to the following description and examples.

In the process for forming a multilayer film according to the present invention, the white coating (A) can be coated directly on a metallic or plastic substrate such as an automobile body or the like. It is generally preferred, however, that the substrate is pre-coated with a primer and/or an intermediate coating, and then cured.

Primer

Cationic electrocoating or anionic electrocoating can be used to coat the substrate with a primer, however, cationic electrocoating is generally preferred in view of the superior corrosion resistance obtained with this process.

The cationic electrocoating process can include the following steps. The primer coating can be obtained by adding, as necessary, a crosslinking agent, a pigment and other additives for coating to an aqueous solution or dispersion of a salt of a cationazable group-containing polymeric substance. The cationazable group-containing polymeric substance includes, for example, those substances obtained by modifying a base resin (e.g. an acrylic resin or an epoxy resin) with an amino compound or the like to introduce a cationizable group into the base resin. By neutralizing the cationizable group-containing polymeric substance with an acid such as organic acid, inorganic acid or the like, an aqueous solution or dispersion can be obtained. As the crosslinking agent, a blocked polyisocyanate compound, an alicyclic epoxy resin or the like can be preferably used.

A metallic substrate is immersed into a bath as a cathode, and an electric current is passed between the cathode and an anode under ordinary conditions to apply the primer coating onto the substrate. The thickness of the resulting film can be varied as desired depending upon the intended application, but preferably is 10 to 30 micrometers as cured. The primer coating can be crosslinked and cured by heating at a temperature of about from 140 to 200° C. for 10 to 40 minutes.

Intermediate Coating

The intermediate coating can be applied on the primer. The intermediate coating can be a liquid coating composition comprising a thermosetting resin composition and a solvent as main components and, as necessary, a coloring pigment, an extender pigment and other additives for coating. The intermediate coating serves to endow the finally obtained multilayer film with improved smoothness, distinctness of image gloss, luster and the like.

Specific examples of the thermosetting resin composition used in the intermediate coating are those compositions obtained by adding, to a base resin such as acrylic resin, polyester resin, alkyd resin or the like, having a crosslinkable functional group such as hydroxyl group or the like, a crosslinking agent such as melamine resin, urea resin, blocked or unblocked polyisocyanate compound or the like. The solvent includes an organic solvent and/or water.

The intermediate coating can be applied on the crosslinked and cured film resulting from the electrodeposition of the primer, or it can be applied to the uncured primer film. In addition, the intermediate coating can be applied by electrostatic coating, air spraying, airless spraying or the like. The preferable thickness of the film of the intermediate coating is generally 10 to 50 micrometers as cured. The film can be crosslinked and cured by heating generally at a temperature of about from 100 to 170° C. for 10 to 40 minutes.

According to the process of the present invention, after the film of the intermediate coating has been crosslinked and cured, a white coating (A) is applied.

White Coating (A)

The white coating (A) used in the process of the present invention can be a liquid composition comprising at least one thermosetting resin composition, at least one metal powder coated with white pigment, and at least one titanium dioxide pigment. The white coating composition (A) is characterized by the resin composition and the combination of both a metal powder coated with a white pigment and a titanium dioxide pigment. As a result, the film obtained from the white coating (A) has an excellent hiding power and can sufficiently hide the sublayer in a thin thickness (as cured) of up to about 25 micrometers, particularly about from 5 to 15 micrometers. Moreover, it is preferred that substantially no intermixing occurs between the uncured film of the coating (A) and a light-iridescent coating (B) applied thereon. Furthermore, the white coating film (A) can independently provide a film superior in whiteness compared with prior white coating films.

The thermosetting resin composition used in the white coating (A) is preferably a composition comprising a base resin such as acrylic resin, polyester resin, alkyd resin or the like, having a crosslinkable functional group such as hydroxyl group or the like and a crosslinking agent such as amino resin (e.g. melamine resin or urea resin) or the like.

The metal powder coated with a white pigment used in the white coating (A) is a metal powder wherein its surface is coated with a white pigment. There is no strict restriction as to the shape of the metal powder, but flake is preferable from the standpoint of improving the hiding power of the white coating (A). The metal powder preferably has an average particle diameter of up to about 10 micrometers, particularly about from 3 to 7 micrometers. Herein, "average particle diameter" is a median diameter obtained by a laser diffraction scattering method using LA-500 (trade name) produced by Horiba, Ltd. (the same applies also hereinafter). The metal powder is preferably a metallic powder of aluminum, copper, stainless steel, brass, an alloy of these metals and the like, and the particle surfaces may be treated with a silane coupling agent or the like.

The metal powder coated with a white pigment can be obtained by coating the surface of the metal powder with a white pigment such as titanium dioxide or the like. The thus-obtained metal powder is a white particle and has no metallic appearance. The titanium dioxide pigment used in combination with the metal powder coated with a white pigment can be a per-se known titanium dioxide pigment. It preferably has an average particle diameter of generally 5 micrometers or less. The surface of the titanium dioxide pigment may be treated with alumina, silica or the like.

In the white coating (A), there is no strict restriction as to the amounts of the metal powder coated with a white pigment and the titanium dioxide pigment, but the preferable amounts are generally about from 0.1 to 30 parts by weight, particularly 1 to 7 parts by weight, of the metal powder coated with a white pigment, and generally 1 to 200 parts by weight, particularly 40 to 120 parts by weight, of the titanium dioxide pigment, per 100 parts by weight of the total solid content of the thermosetting resin composition in the white coating (A). Further, the preferable amount of the metal powder coated with a white pigment is generally 1 to 15 parts by weight, particularly 2 to 7 parts by weight per 100 parts by weight of the titanium dioxide pigment.

In the present invention, by using both the metal powder coated with a white pigment and the titanium dioxide pigment in the white coating (A), it is possible to form a film of the white coating (A) that is thinner than previously desirable, i.e., a film hiding power (as cured) of 25 micrometers or less, particularly 5 to 15 micrometers.

In the white coating (A), it is important to use the metal powder coated with a white pigment and the titanium dioxide pigment in combination. The two components are used so that the resulting white coating (A) shows a cured film hiding power of 25 micrometers or less.

In the present specification, "hiding power" refers to a minimum film thickness in which the color of the sublayer cannot be recognized with naked eyes. It is specifically a minimum film thickness in which when a film is formed on a black-and-white-checkered substrate and visual observation is made from above the film, the black and white color of the substrate is unrecognizable.

The white coating (A) can be prepared by dispersing the above-mentioned components in a solvent such as an organic solvent and/or water.

The film formed with the white coating (A) exhibits superior whiteness. Specifically, the color is 70 to 100, preferably 85 to 100 in terms of L value, and 5 or less, preferably 1 or less in terms of a and b values in Lab color system. As long as a film of such a color is formed, the white coating (A) can further comprise, as necessary, a color pigment and a metallic pigment other than the above-mentioned metal powder coated with a white pigment and the titanium dioxide pigment, a precipitation inhibitor, a rheology controlling agent and the like. The white coating (A) shows no or substantially no glittering appearance.

The film elongation ratio of the white coating (A) at 20° C. is preferably 2.5 to 50%, particularly 5 to 35%, in its cured film state. When the film elongation ratio deviates from this range, the resulting multilayer film generally has reduced chipping resistance, smoothness, impact resistance and the like. The film elongation ratio can be easily controlled by changing the kinds, properties, etc. of the basic resin and crosslinking agent used in the white coating (A).

Herein, "film elongation ratio" referred to for the white coating (A) is a value obtained when the measurement was made for a film formed by heat-curing the white coating (A) alone. The film elongation ratio is specifically obtained by coating the white coating (A) on a tinplate sheet in a film thickness of 15 micrometers as cured, heat-curing the resulting film at 140° C. for 30 minutes, separating the cured film by a mercury amalgamation method, cutting the separated film into a rectangular test piece of 20 mm (length)×5 mm (width), and subjecting the test piece to a tensile test at a tensile speed of 20 mm/min at 20° C. using a universal tensile strength tester with a controlled temperature bath (Autograph S-D, a product of Shimadzu Corporation) until the test piece is ruptured.

In the present invention, the white coating (A) is preferably applied on the crosslinked and cured film of the intermediate coating in a film thickness of generally 25 micrometers or less, particularly 5 to 15 micrometers as cured. The white coating (A) can be applied by electrostatic coating, air spraying, airless spraying or the like. In the present invention, it is preferable that the film of the white coating (A) is dried at room temperature or at an elevated temperature (100° C. or less is preferable) without crosslinking and curing it and then a light-iridescent coating (B) is applied thereon.

Light-Iridescent Coating (B)

The light-iridescent coating (B) is applied on the uncrosslinked film of the white coating (A) and is a liquid coating composition which comprises a thermosetting resin composition and a light-iridescent pigment.

The light-iridescent coating (B) contains a light-iridescent pigment and therefore gives a light-iridescent pattern. Further, the film has a small hiding power and therefore the hue of the film of the white coating (A) can be seen therethrough.

The thermosetting resin composition used in the light-iridescent coating (B) is preferably a composition comprising a base resin such as acrylic resin, polyester resin, alkyd resin or the like, having a crosslinkable functional group such as hydroxyl group or the like and a crosslinking agent such as amino resin (e.g. melamine resin or urea resin) or the like.

The light-iridescent pigment used in the light-iridescent coating (B) is a pigment of scaly particles having a light-iridescent action. It can include, for example, mica, mica coated with a metal oxide such as titanium dioxide, iron oxide or the like.

The average particle diameter of the light-iridescent pigment can be generally 10 micrometers or more, preferably 10 to 50 micrometers, more preferably 15 to 40 micrometers. The amount of the light-iridescent pigment used is 0.1 to 20 parts by weight, preferably 3 to 10 parts by weight per 100 parts by weight of the thermosetting resin composition.

The light-iridescent coating (B) can be obtained by mixing or dispersing the above-mentioned components with or in a solvent such as an organic solvent and/or water.

The film elongation ratio of the light-iridescent coating (B) is 20% or less, preferably 10% or less at 20° C. The "film elongation ratio" is a value obtained in the same manner as mentioned with respect to the white coating (A).

The hiding power of the light-iridescent coating (B) should be 50 micrometers or more, preferably 60 micrometers or more, more preferably 80 micrometers or more. When the hiding power is less than 50 micrometers, it is difficult to reflect the hue of the sublayer, i.e. the film of the white coating (A), and the beauty, particularly the transparency of the resulting multilayer film is reduced.

The light-iridescent coating (B) can be applied on the uncrosslinked and uncured film of the white coating (A) by electrostatic coating, air spraying, airless spraying or the like in a film thickness of 10 to 50 micrometers as cured. At this time, there should not be any intermixing between the uncrosslinked and uncured film of the white coating (A) and the light-iridescent coating (B) applied.

In the present invention, the film of the light-iridescent coating (B) can be dried at room temperature or at an elevated temperature (a temperature not higher than 100° C. is preferred) without crosslinking and curing the resulting film, or the film resulting from the white coating (A). Thereafter, a clear coating (C) is applied thereon.

Clear Coating (C)

The clear coating (C) can be applied on the uncrosslinked film of the light-iridescent coating (B). The clear coating (C) can be a liquid coating composition which comprises a thermosetting resin composition and a solvent, and can form a transparent film.

The thermosetting resin composition can include, for example, a composition comprising a base resin such as acrylic resin, polyester resin, alkyd resin or the like, having a crosslinkable functional group (e.g. hydroxyl group) and a crosslinking agent such as amino resin (e.g. melamine resin or urea resin), polyisocyanate compound or the like. Other preferred thermosetting resins can include a thermosetting resin composition which need not contain, as the crosslinking agent, the above-mentioned amino resin (e.g. melamine resin or urea resin), such as described in, for example, U.S. Pat. Nos. 4,650,718, 4,703,101, 4,681,811, 4,772,672, 4,895,910, 5,026,793, 5,284,919, 5,389,727 and 5,274,045, EP-A-353734 and 559186.

An organic solvent and/or water can be used as the solvent in the clear coating (C). The clear coating (C) can be prepared by dissolving or dispersing the thermosetting resin composition in the solvent.

The clear coating (C) can further comprise a color pigment, a metallic pigment, a light-iridescent pigment, an ultraviolet absorber and the like as long as the transparency of the film of the clear coating (C) is not impaired.

The clear coating (C) can be applied on the uncured film of the light-iridescent coating (B) preferably by electrostatic coating, air spraying, airless spraying or the like in a film thickness of 10 to 50 micrometers as cured.

According to the present process, a multilayer film can be obtained by applying, onto a substrate, the white coating (A), the light-iridescent coating (B), and the clear coating (C) in this order without substantially curing the resulting films of the coatings (A), (B) and (C), and then heating the three films to crosslink and cure them simultaneously at a temperature of 100 to 180° C. for 10 to 40 minutes.

The present process for formation of a multilayer film can provide the following effects:

(1) Since there occurs no intermixing when the light-iridescent coating (B) is directly applied on the uncured film of the white coating (A), the multilayer film formed is superior in finish appearance.

(2) Since the white coating (A) shows an excellent film hiding power, the total thickness of the multilayer film formed can be made smaller.

(3) The multilayer film formed has improved properties (e.g. improved smoothness and chipping resistance).

(4) The multilayer film formed is superior in whiteness.

EXAMPLES

The present invention is hereinafter described more concretely by way of Examples and Comparative Examples, in which parts and percentages are all by weight.

I. Samples (1) Primer (Applied by Cationic Electrocoating)

ELECRON 9400 HB (a trade name, a product of Kansai Paint Co., Ltd., an epoxy resin polyamine-blocked polyisocyanate compound type).

(2) Intermediate Coating

TP-37 PRIMER SURFACER (a trade name, a product of Kansai Paint Co., Ltd., a polyester resin-melamine resin type, an organic solvent type).

(3) White Coating (A)

Organic solvent type coatings obtained by mixing a polyester resin, a melamine resin, a fine aluminum powder coated with a white pigment and a titanium dioxide in the proportions shown in Table 1. In Table 1, the amount of each component is shown in a solid content ratio.

In Table 1:

(*1) A phthalic anhydride/hexahydrophthalic anhydride type polyester resin (number-average molecular weight= about 4,000, hydroxyl value=82, acid value=7).

(*2) U-Van 28-60 (a product of MITSUI TOATSU CHEMICALS, INC.).

(*3) A fine aluminum powder having a particle diameter of 3 to 7 micrometers wherein its surface is coated with titanium dioxide.

(*4) K-9800 (a product of Asahi Chemical Industry Co., Ltd., average particle diameter=5 to 6 micrometers).

(*5) Titanium JR 701 (a product of TEIKOKU KAKO CO., LTD., average particle diameter=0.3 to 0.6 micrometers).

(*6) Each of the white coatings (A-1) to (A-3) was coated on a tinplate sheet in a film thickness of 15 micrometers as cured, and then heat-cured at 140° C. for 30 minutes. The cured film was separated by an mercury amalgamation method and cut into a test sample of 20 mm (length)×5 mm (width). The test sample was subjected to a tensile test at 20° C. at a tensile speed of 20 mm/min using a universal tensile tester with a controlled temperature bath (Autograph S-D, a product of Shimadzu Corporation), and an elongation ratio (%) was measured when the test sample was ruptured.

(*7) Coating films were formed on a black and white substrate of checkered pattern, in various film thickness. A minimum film thickness (micrometer) when the black and white colors could not be distinguished with naked eyes, was measured.

(4) Light-iridescent Coatings (B)

Organic solvent type coatings obtained by mixing an acrylic resin, a melamine resin and a light-iridescent pigment in the proportions shown in Table 2. In Table 2, the amount of each component is shown in a solid content ratio. In Table 2:

(*8) An acrylic resin having a number-average molecular weight of about 2,000, a hydroxyl value of 70 and an acid value of 8.

(*9) U-Van 28-60 (a product of MITSUI TOATSU CHEMICALS, INC.).

(*10) Europearl (a product of Mearl Corp., average particle diameter=14 to 18 micrometers).

(5) Clear Coating (C)

MAGICRON CLEAR (a trade name, a product of Kansai Paint Co., Ltd., an acrylic resin-melamine resin type, an organic solvent type).

II. Examples and Comparative Examples

The above-mentioned samples were applied and heat-cured according to the coating steps shown in Table 3, to form multilayer films. The films were tested for performances and the results are shown in Table 3.

On a degreased and zinc phosphate-treated steel plate was electrocoated with a primer by cationic electrocoating so as to deposit a film of 20 micrometers in thickness as cured (hereinafter, thickness refers to thickness as cured). The cationic electrocoated primer film was heated at 170° C. for 30 minutes for curing. On the cured primer the intermediate coating was applied so as to give a film of 30 micrometers in thickness. The film obtained from the intermediate coating was heated at 140° C. for 30 minutes for curing.

On the cured film of the intermediate coating, white coatings (A-1) to (A-3) were applied by the use of a minibell type rotary electrostatic coating machine under the conditions of discharge amount=150 cc, 50,000 rpm, shaping pressure=1 kg/cm2, gun distance=30 cm, booth temperature 20° C. and booth humidity=75%. The film thickness of the white coating (A) was 10 to 15 micrometers.

The resulting plate was allowed to stand in the booth for 5 minutes. Then, on the uncured film of the white coating (A) one of the light-iridescent coatings (B-1) to (B-3) was applied by the use of a REA gun under the conditions of discharge amount=180 cc, atomization pressure=2.7 kg/cm2, pattern pressure=3.0 kg/cm2, gun distance=30 cm, booth temperature 20° C. and booth humidity=75%. The film thickness of the light-iridescent coating (B) was 10 to 15 micrometers.

The resulting plate was allowed to stand in the booth for 5 minutes. On the uncured film of the light-iridescent coating (B) the clear coating (C) was applied by the use of a minibell type rotary electrostatic coating machine under the conditions of discharge amount=300 cc, 40,000 rpm, shaping pressure=5 kg/cm2, gun distance=30 cm, booth temperature 20° C. and booth humidity=75 %. The film thickness of the clear coating (C) was 45 to 50 micrometers.

The resulting plate was allowed to stand at room temperature for 3 minutes and then heated at 140° C. for 30 minutes in a dryer of hot air circulation type to subject the three-layered film of the white coating (A), the light-iridescent coating (B), and the clear coating (C) to simultaneous curing. The performances of each resulting multilayer film was measured and rated as follows.

Smoothness: rated visually according to the following yardstick.

a: Good b: Slight surface roughening c: Striking surface roughening

Chipping resistance: Measured using a gravelometer and 100 g of No. 7 crushed stones under the conditions of air pressure=4.5 kg/cm2 and angle=45°. Rated visually according to the following yardstick.

a: No or slight scar caused by impact was seen on part of the clear coating film.

b: White coating is exposed owing to the partial peeling of light-iridescent coating film.

Finish Appearance: The light-iridescence of the multilayer film was examined visually and rated according to the following yardstick.

a: Light-iridescence is good.

b: Light-iridescence is poor.

Whiteness: Measured L, a and b values using a calorimeter.

TABLE 1

| | White coating (A) | | |
|---|---|---|---|
| | A-1 | A-2 | A-3 |
| Polyester resin (*1) | 65 | 70 | 75 |
| Melamine resin (*2) | 35 | 30 | 25 |
| Fine aluminum powder (*3) | 7 | 5 | — |
| Aluminum flake (*4) | — | — | 5 |
| Titanium dioxide pigment (*5) | 120 | 100 | 100 |
| Elongation ratio (%) (*6) | 6 | 12 | 12 |
| Hiding power (μm) (*7) | 10 | 15 | 15 |
| Lab color system | | | |
| L value | 90 | 90 | 65 |
| a value | 0.5 | 0.5 | 0.5 |
| b value | 0.5 | 0.5 | −1 |

TABLE 2

| | Light-iridescent coating (B) | | |
|---|---|---|---|
| | B-1 | B-2 | B-3 |
| Acrylic resin (*8) | 65 | 70 | 75 |
| Melamine resin (*9) | 35 | 30 | 25 |
| Light-iridescent pigment (*10) | 8 | 8 | 8 |
| Elongation ratio (%) (*6) | 7 | 10 | 11 |
| Hiding power (μm) (*7) | 80 | 80 | 85 |

TABLE 3

| | Examples | | | Comparative Example |
|---|---|---|---|---|
| | 1 | 2 | 3 | 1 |
| Electrocoating | | | | |
| Symbol | ELECRON 9400 HB | | | |
| Curing | 170° C. × 30 min | | | |
| Intermediate coating | | | | |
| Symbol | TP-37 PRIMER SURFACER | | | |
| Curing | 140° C. × 30 min | | | |

TABLE 3-continued

| | Examples | | | Comparative Example |
|---|---|---|---|---|
| | 1 | 2 | 3 | 1 |
| White coating | | | | |
| Symbol | A-1 | A-2 | A-1 | A-3 |
| Drying | Room temp. × 5 min | | | |
| Light-iridescent coating | | | | |
| Symbol | B-1 | B-2 | B-3 | B-1 |
| Drying | Room temp. × 5 min | | | |
| Clear coating | | | | |
| Symbol | MAGICRON CLEAR | | | |
| Curing | 140° C. × 30 min | | | |
| Performance test result | | | | |
| Smoothness | a | a | a | a |
| Chipping resistance | a | a | a | a |
| Finish appearance | a | a | a | a |
| Lab color system | | | | |
| L value | 90 | 90 | 90 | 65 |
| a value | 0.5 | 0.5 | 0.5 | 0.5 |
| b value | 0.5 | 0.5 | 0.5 | −1 |

We claim:

1. A process for forming a multilayer film comprising applying, in the following order, (A) a liquid white coating comprising a thermosetting resin composition, a metal powder coated with a white pigment, and a titanium dioxide pigment, (B) a light-iridescent coating, and (C) a clear coating to form three coating films on a substrate, and heating the substantially uncured three films to crosslink and cure them simultaneously.

2. A process of claim 1, wherein the film formed from the white coating (A) has a film elongation ratio of about from 2.5 to 50% at 20° C.

3. A process of claim 1, wherein the film formed from the white coating (A) has a cured film hiding power of up to about 25 micrometers.

4. A process of claim 1, wherein the liquid white coating (A) is a composition comprising 100 parts by weight of a thermosetting resin composition, about from 0.1 to 30 parts by weight of a metal powder coated with a white pigment, and about from 1 to 200 parts by weight of a titanium dioxide pigment.

5. A process of claim 1, wherein the liquid white coating (A) is a composition comprising 100 parts by weight of a thermosetting resin composition, about from 1 to 7 parts by weight of a metal powder coated with a white pigment, and about from 40 to 120 parts by weight of a titanium dioxide pigment.

6. A process of claim 1, wherein the liquid white coating (A) comprises a metal powder coated with a white pigment in an amount of about from 1 to 15 parts by weight per 100 parts by weight of a titanium dioxide pigment.

7. A process of claim 1, wherein the liquid white coating (A) comprises a metal powder coated with a white pigment in an amount of about from 2 to 7 parts by weight per 100 parts by weight of a titanium dioxide pigment.

8. A process of claim 1, wherein the liquid white coating (A) can form a white film having a L value of about from 70 to 100 and a and b values of 5 or less in the Lab color system.

9. A process of claim 1, wherein the film formed from the liquid white coating (A) has a thickness of up to about 25 micrometers as cured.

10. A process of claim 1, wherein the light-iridescent coating (B) has a film elongation ratio of up to about 20% at 20° C.

11. A process of claim 1, wherein the light-iridescent coating (B) has a cured film hiding power of at least about 50 micrometers.

12. A process of claim 1, wherein the light-iridescent coating (B) is a liquid composition comprising 100 parts by weight of a thermosetting resin composition and about from 0.1 to 20 parts by weight of a light-iridescent pigment.

13. A process of claim 1, wherein the light-iridescent coating (B) is a liquid composition comprising 100 parts by weight of a thermosetting resin composition and about from 3 to 10 parts by weight of a light-iridescent pigment.

14. A process of claim 1, wherein the light-iridescent coating (B) has a thickness of about from 10 to 50 micrometers as cured.

15. A process of claim 1, wherein the clear coating (C) has a thickness of about from 10 to 50 micrometers as cured.

16. A process of claim 1, wherein the films formed from the coatings (A), (B) and (C) are heated at a temperature of 100 to 180° C. to crosslink and cure them simultaneously.

17. A coated article obtained by the process of claim 1.

* * * * *